US006883758B2

(12) United States Patent
Ruocchio

(10) Patent No.: US 6,883,758 B2
(45) Date of Patent: Apr. 26, 2005

(54) REED RELAY FOR REMOTE MAGNETIC OPERATION OF MODEL TRAINS

(76) Inventor: Albert C. Ruocchio, 429 Chadwick Dr., Raleigh, NC (US) 27609

( * ) Notice: Subject to any disclaimer, the term of this patent is extended or adjusted under 35 U.S.C. 154(b) by 0 days.

(21) Appl. No.: 10/241,829

(22) Filed: Sep. 12, 2002

(65) Prior Publication Data

US 2003/0071173 A1 Apr. 17, 2003

Related U.S. Application Data

(60) Provisional application No. 60/318,313, filed on Sep. 12, 2001.

(51) Int. Cl.[7] ..... B61L 3/00

(52) U.S. Cl. ..... 246/193; 105/241.2

(58) Field of Search ..... 246/1 C, 178, 246/192 R, 193, 194, 201, 202, 206, 207, 217, 219, 253, 251; 105/239, 240, 241.2, 241.1; 191/10

(56) References Cited

U.S. PATENT DOCUMENTS

| | | | | | |
|---|---|---|---|---|---|
| 1,162,468 | A | * | 11/1915 | Fox | 246/197 |
| 1,374,954 | A | * | 4/1921 | Ruthven | 246/202 |
| 1,797,560 | A | * | 3/1931 | Thompson | 246/63 A |
| 2,096,936 | A | * | 10/1937 | Howe | 246/63 A |
| 2,223,905 | A | | 12/1940 | Beyer et al. | |
| 2,256,862 | A | | 9/1941 | Duffy | |
| 2,277,455 | A | * | 3/1942 | Rexford | 446/428 |
| 2,292,565 | A | | 8/1942 | Jordan | |
| 2,305,491 | A | * | 12/1942 | Pettit | 446/428 |
| 2,859,556 | A | | 11/1958 | Smith et al. | |
| 2,930,889 | A | * | 3/1960 | Hours | 246/202 |
| 3,069,023 | A | | 12/1962 | Ross | |
| 3,111,229 | A | | 11/1963 | Edwards et al. | |
| 3,145,958 | A | | 8/1964 | Dasburg et al. | |
| 3,579,041 | A | | 5/1971 | Paine | |
| 3,659,725 | A | | 5/1972 | Passalacqua | |
| 3,660,653 | A | * | 5/1972 | Peterson | 246/182 BH |
| 3,724,680 | A | | 4/1973 | Hines | |
| 3,840,127 | A | | 10/1974 | Edwards et al. | |
| 3,942,648 | A | | 3/1976 | Edwards et al. | |
| 4,072,220 | A | | 2/1978 | Hamada | |
| 4,316,346 | A | | 2/1982 | Brand et al. | |
| 4,335,820 | A | | 6/1982 | Gramera | |
| 4,369,943 | A | * | 1/1983 | Hussein | 246/127 |
| 4,408,817 | A | * | 10/1983 | Mattis | 439/620 |
| 4,847,719 | A | | 7/1989 | Cook et al. | |
| 4,928,109 | A | | 5/1990 | Bonebright et al. | |
| 5,012,236 | A | | 4/1991 | Troyk et al. | |
| 5,174,216 | A | * | 12/1992 | Miller et al. | 104/296 |
| 5,417,537 | A | | 5/1995 | Miller | |
| 5,441,223 | A | | 8/1995 | Young et al. | |
| 5,451,017 | A | | 9/1995 | Graff et al. | |

(Continued)

OTHER PUBLICATIONS

John Swanson, " Pickup Shoes Improve Performance", Railroad Model Craftsman, Feb. 1980, p. 64–67.

*Primary Examiner*—Mark T. Le
(74) *Attorney, Agent, or Firm*—Merek, Blackmon & Voorhees, LLC

(57) ABSTRACT

An apparatus for performing a function on a model train car on a track includes an electrically operated mechanism mounted on the car for performing a function on the car. A reed switch is operatively connected to the mechanism for activating the mechanism. The reed switch has contacts movable from a first position, in which the contacts are out of contact with one another, to a second position, in which the contacts are in contact with one another. A magnet associated with the track moves the contacts of the reed switch from the first position to the second position to activate the mechanism.

16 Claims, 8 Drawing Sheets

U.S. PATENT DOCUMENTS 5,509,546 A 4/1996 Staat
5,678,789 A 10/1997 Pipich
5,754,094 A * 5/1998 Frushour ..... 340/384.7
5,775,525 A 7/1998 Brill
5,823,371 A 10/1998 Riley et al.
5,826,736 A 10/1998 Weber
5,836,253 A 11/1998 Kunka
5,855,004 A * 12/1998 Novosel et al. ..... 704/272
5,870,270 A 2/1999 Riley et al.
5,952,797 A 9/1999 Rössler
6,095,351 A 8/2000 Rössler
6,113,458 A 9/2000 Brown
6,123,298 A 9/2000 Riley

* cited by examiner

REED RELAY FOR REMOTE MAGNETIC OPERATION OF MODEL TRAINS

CROSS-REFERENCE TO RELATED APPLICATION

This application claims the priority of Provisional Application No. 60/318,313, filed Sep. 12, 2001.

BACKGROUND OF THE INVENTION

In the field of model railroadry, it is desirable to add features and functions to enhance the basic process of a train running around the length of a track. As a result, model railroad manufacturers have spent considerable time and effort to develop methods and apparatus, both mechanical and electrical, that offer extra features which appeal to the senses of sight and sound as well as functions which create operational features similar to that of real trains. There are several features in particular that have been the focus of much research, development and design in the model train industry. Some of the most notable developments involve apparatus emitting train sounds, units producing smoke or steam effects and various methods of coupling and uncoupling train cars.

A magnet or an electromagnet has been utilized in inventions related to model railroads. In particular, coupling and uncoupling devices often include utilization of a magnet or electromagnet to create a movement of the train car couplers, either by magnetic attraction or repulsion, to result in the coupling (joining) of two train cars or the uncoupling (separation) of two train cars. U.S. Pat. No. 2,223,905 to Beyer et al. uses an electromagnet located in a track section. This design, as well as similar inventions, requires an armature for the electromagnet projected as a lever from the track section to mechanically contact and uncouple the train car coupling members. These mechanical devices must be located and arranged in a very precise manner.

In other coupling and uncoupling designs, such as U.S. Pat. No. 3,069,023 to Ross, magnetic attraction provides the mechanism for uncoupling the coupler members by positioning magnets at predetermined locations of a track section. When a train car is appropriately positioned in conjunction with the magnets, sections of the couplers move out of the coupled position as a result of attraction to the magnet. In U.S. Pat. No. 5,775,525 to Brill, magnetic attraction utilizes a direct physical contacting of the magnets located on each of the train car coupling assemblies. Conversely, other designs, such as U.S. Pat. No. 3,840,127 to Edwards et al., implement magnetic repulsion to push away or deflect the coupler members in order to achieve separation of the train cars.

Model train enthusiasts seek out and enjoy features and decorations of train cars that add an element of novelty and uniqueness to their train layouts, but at the same time, they desire an adherence to the prototypical look and function. For instance, most model train operators would consider a model train sound system which had a recording of a real train preferable to one with a mechanically produced imitation sound. Although highly entertaining, these additional features often require expensive accessories for operation.

U.S. Pat. No. 4,369,943 to Husein presents an interesting combination of operational accessories that replicates conditions at a train gate crossing. A detector circuit uses two pairs of magnetically-operated relays positioned beneath the tracks of a grade crossing and a separate single pair of magnetically-operated relays located at the grade crossing. A locomotive with a permanent magnet triggers the two pairs of relays as it passes the grade crossing and activates the coil relays to operate the lowering of the crossing gate, flashing lights and sounding bells. Then, as a train car with a permanent magnet for operating the single pair grade crossing relays passes the grade crossing, the gate raises and the lights and bells are deactivated. One disadvantage in this design, as well in other similar designs, is that the relays must be triggered every time the train with the magnet passes.

Presently, it is reasonable and expected by users to operate these cars anywhere on the track with signaling transmitted by radio control or by infrared. Cars which operate by radio control or infrared must be outfitted with roller pick ups such that the track voltage can be used anywhere on the track. Specific remote controls are also required. Activated by a remote control, a control system shown in U.S. Pat. No. 5,441,223 to Young et al. sends encoded commands to a receiver and, in the process, generates an electromagnetic field which extends several inches about the track to activate the receiver in the train car. This system involves a complex system of command controlled functions that utilizes the specifically designed remote control.

In the field of model trains, track sections often have three rails with current running through the middle rail and two grounded outer rails. Conventionally, power is sent to the car through a special section of track that adds two additional rails. The additional rails are centered between the middle rail and the two outer rails. Voltage is transmitted to the car through pickup shoes, or slide shoes, attached to the train car and aligned with the two additional rails. Not only does this design require the use of a five rail track section which does not look prototypical, but pickup shoes are required on the train car in order for it to operate. The presence of these shoes on the bottom of the train car also adds an extra, non-prototypical looking part to the train and creates the problem of the shoes dragging or catching as the cars go around the track. Even if a model train operator desires to use such a train car only infrequently, the five-rail track and the pickup shoes are always present.

SUMMARY OF THE INVENTION

The present invention relates to a unique use of a reed relay that includes a reed switch and a coil for focusing a magnetic field. A reed relay is an electromechanical arrangement operated by the flow of electricity in one circuit to control the flow of electricity in another circuit. The reed relay senses and is energized by an external magnetic field of an orthogonal electromagnet and, thereby, triggers an operation in an electric model railroad train car. In particular, an activating electromagnet is situated in a specific model railroad track section and a reed relay is situated in a model electric train car. The reed relay triggers the train car to perform a movement or operation such as, but not limited to, a lifting and dumping action. With the present invention, the reed relay can actuate dumping coal from a coal car, dumping logs from a log car or similar actions in other types of train cars by operating a motor or solenoid to commence motion or operation within the car.

The magnetic field created by the electromagnet allows activation of the reed relay within a range of several inches and does not require the train car to be positioned with any great accuracy. Instead, the reed relay and magnet can be positioned anywhere within a given range.

The present invention offers the ability to add unique operational features to a train car by a simple electrical means. This benefits the model train operator by providing a variety of interesting, operating train cars to a layout without the need for expensive accessories required to operate the train cars. In addition, the invention maintains a more prototypical look to the train car.

Another advantage of the present invention is that the operational feature of the train or train accessory is only activated when the model train operator chooses to initiate operation, not every time the train passes a certain point on the track.

A remote controller is not required. As such, cars can operate anywhere on the track and a train operator can use the old fixed track if remote control is not available or desirable by the train layout operator.

As discussed above, the operation of conventional automatic cars through contacts to a fourth and fifth rail requires energizing an iron core relay through very special contact shoes. It should be noted that this operation is not a very smooth one because voltage is applied to a solenoid in the car. As a result, the action is more of a "jump" when contact is made and track voltage is applied through the terminals.

Since the train car must be located over the uncoupling coil in the track in order to be operated, the reed relay is arranged such that the end of the relay is at the center of the car. That allows the operator to locate the car such that the visibly obvious coil in the track is approximately in the center. The coil of the reed relay is shorted such that when the magnetic field is present, a current will flow in the coil to guarantee positive operation of the reed switch inside the relay. The coil acts as a very precise locating device for the field. When the coil is used for uncoupling, a plate is placed over the coil and vertical lines of magnetic flux pull the plate or other metal device down and the coupler opens. However, if the reed relay is centered exactly over the coil, the lines of magnetic flux would sum to zero in the coil. The end of the reed relay should be offset from at the center of the car and the coil should be approximately centered underneath the car. With the car in position over the coil and the coil energized with an AC or DC signal, the reed switch inside the relay's sensing coil closes. The switch is then connected to the supply voltage on one end is and the other end connected to the "OR" circuit at the output of the radio receiver. Once the "OR" circuit is satisfied, either by the radio receiver signal or the reed relay, the DC motor operates to produce the deserved function. At the end of the operation, the DC motor resets and the car is ready for another cycle. The motor operation is set such that the signal, either the radio receiver or the reed relay, need not be present for more time than it takes for the operation to begin. Keeping the magnetic flux on for more that this length of time does nothing and the button can be turned off at any time. If energized past the reset time, it will start for a second time.

In addition, this shoeless or contactless voltage control need not be limited to cars outfitted with radio control. The reed relay assembly can be used in any application where operation of a motor to perform a specific function is necessary and the alignment of the car with the additional rails is undesired. In other words, the car can use this method as the only operational signal receiver because the relay contact operates the unit independently.

Further features and advantages of the invention, as well as the structure and operation of various embodiments of the invention, are described in detail below with reference to the accompanying drawings.

DETAILED DESCRIPTION OF THE PRESENT INVENTION

Figure 1:
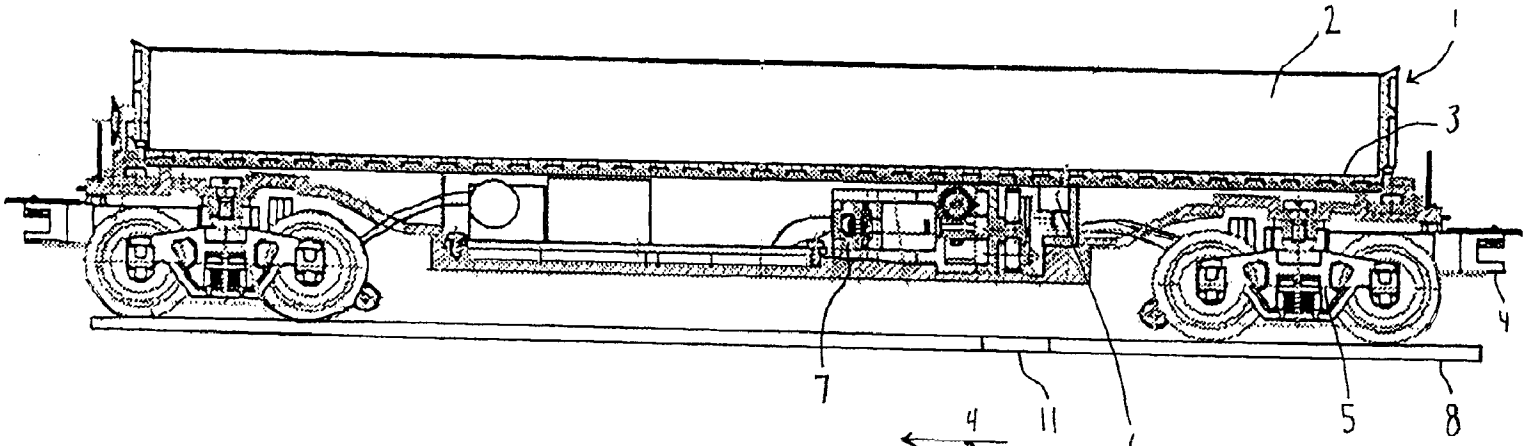
FIG. 1 is a side elevational view of a model railroad train car incorporating the reed relay of the present invention, the car supported by a track.
Figure 2:
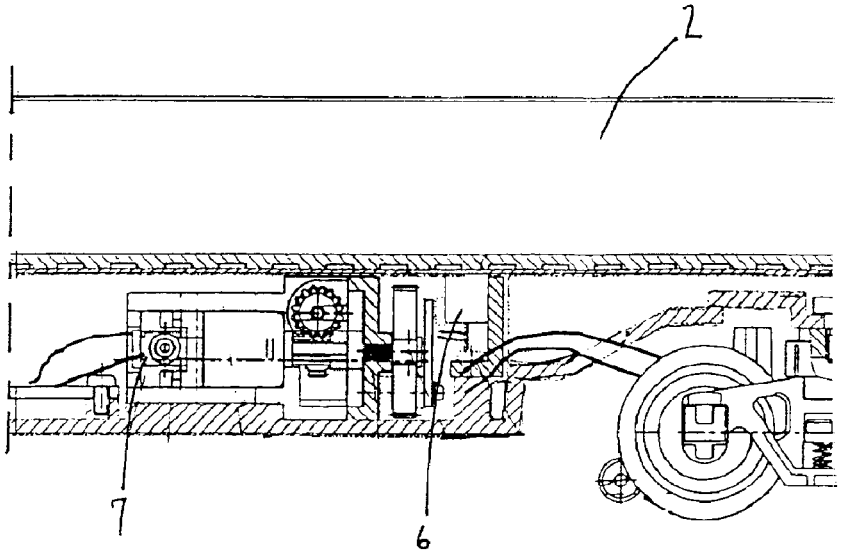
FIG. 2 is an enlarged sectional view of the motor and reed relay of the train car shown in FIG. 1.

As can be seen from FIGS. 1 and 2, a model train car 1 according to the present invention includes a train shell or train body 2, a train chassis 3, coupling mechanisms 4, wheel and truck assemblies 5, and a reed relay switch assembly 6. The reed relay switch assembly 6 actuates a motor 7 to perform a specific operation in the train car. An actuation assembly 11 is located in a track section 8 underneath the train car 1.

Figure 3:
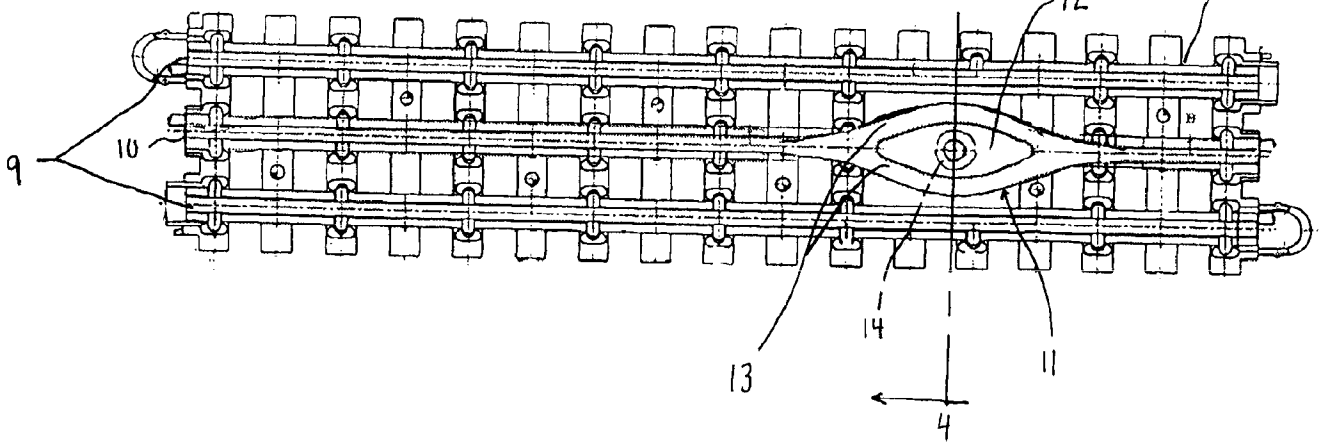
FIG. 3 is a top plan view of a universal or remote uncoupling track section.
Figure 4:
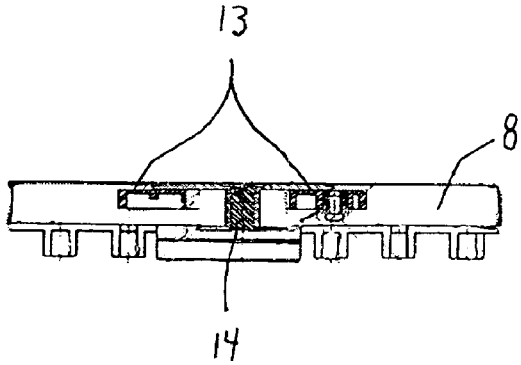
FIG. 4 is an enlarged vertical cross section taken along the line 4—4 in FIG. 3.
Figure 5:
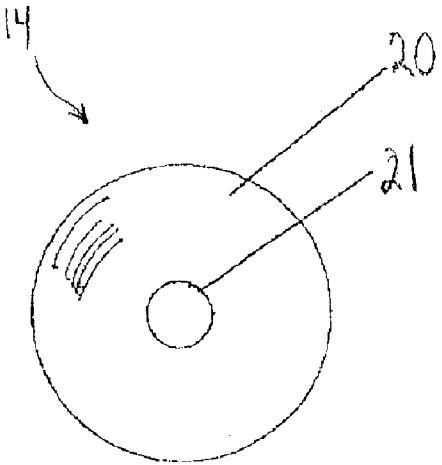
FIG. 5 is a schematic enlarged top view of the electromagnet shown in FIG. 3.

As is shown in FIGS. 3 and 4, a model railroad track section 8 includes three basic metal rails: two outer rails 9 and a middle rail 10. The oval-shaped remote activation assembly 11 has a cover 12 which is encompassed by a division of the middle rail 10. The activation assembly 11 includes two inner, curved rails 13 which diverge and converge to form a portion of the middle rail 10. An electromagnet 14 is positioned in a central area within the activation assembly 11. When activated, the electromagnet 14 produces a magnetic field that extends several inches from the center of the electromagnet 14, preferably about 1 to 1.5 inches. As is shown in FIG. 5, the electromagnet 14 has an iron core 21 surrounded by a coil 20. The electromagnet 14 is energized by an accessory power source within or connected to the track. Voltage from the power source can be applied to the electromagnet 14 either with a switch located on or connected to the track assembly or by remote control. Although the preferred embodiment utilizes an electromagnet arranged in a track with three rails, the electromagnet can also be arranged in a track with more or less rails, for example, a track with two rails.

Figure 6:
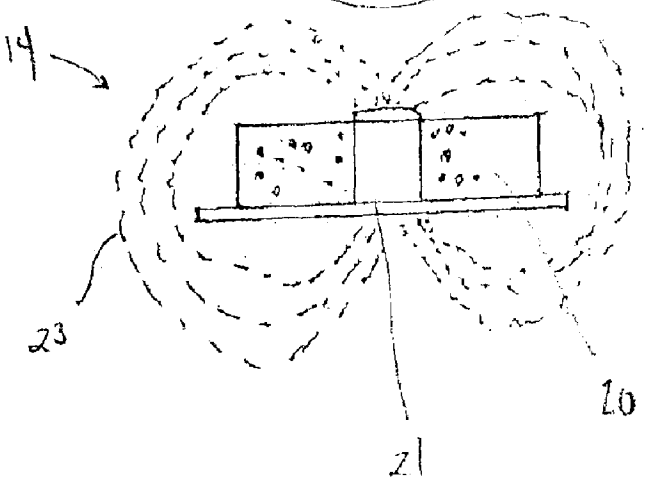
FIG. 6 is a schematic vertical cross section through the electromagnet of FIG. 4, with a representation of the magnetic field produced thereby.
Figure 7:
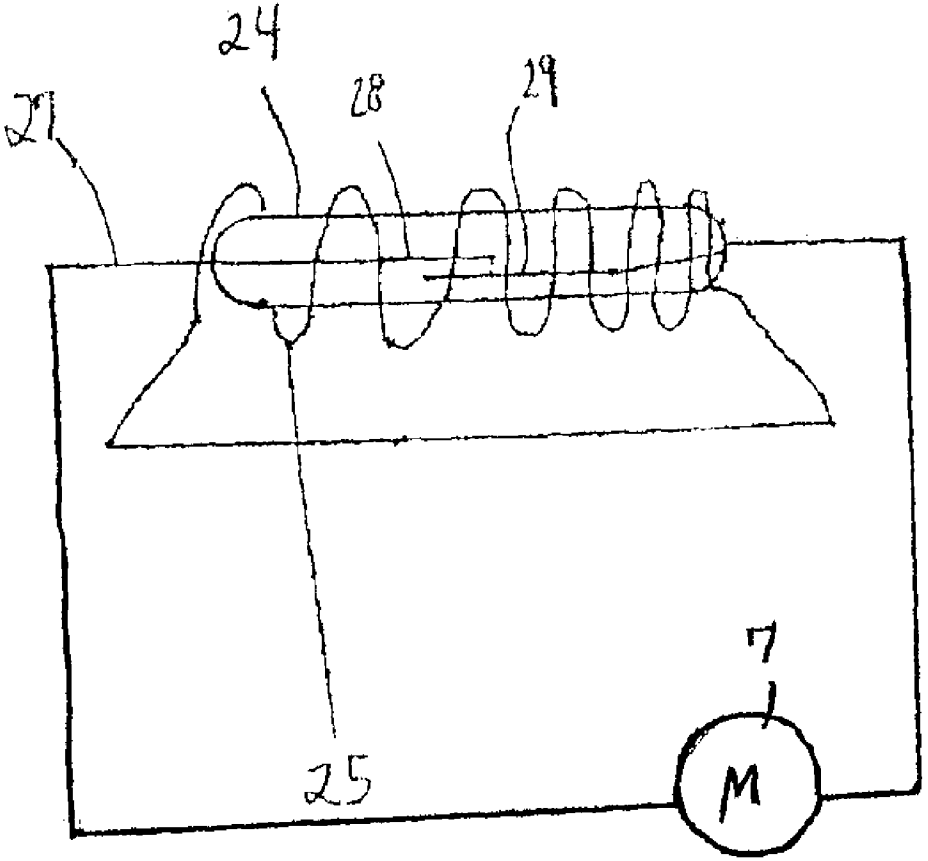
FIG. 7 is an enlarged representation of the reed relay shown in FIG. 1.

FIG. 6 is a representation of the magnetic field 23 produced by the electromagnet 14. As is shown in FIG. 7, the reed relay 6 preferably includes a magnetic reed switch 27 enclosed by a glass envelope 24. The reed switch 27 includes two reed contacts 28, 29. In the preferred embodiment, a coil 25 is wrapped around the glass envelope 24 and is short circuited, with opposite ends of the coil connected to one another to form a sort circuit. The magnetic field from the electromagnet 14 induces a current in the short circuited coil 25 to focus the magnetic field from the electromagnet 14 and ensure that the reeds 28, 29 contact and close the relay switch 27. More specifically, the current in the coil circuit produces an electromagnetic field that adds to the field of the electromagnet 14 and assures that the reeds 28, 29 are continuously held in firm contact with one another. In an alternate embodiment, the coil 25 is not necessary and the field produced by the electromagnet 14 can close the reed relay 6 without the focusing function of the short circuited coil 25. In another embodiment, the magnet is not located underneath the reed switch itself, but is only underneath the short circuit coil 25. The preferred embodiment is the most reliable arrangement for ensuring that the reeds 28, 29 contact.

Figure 8:
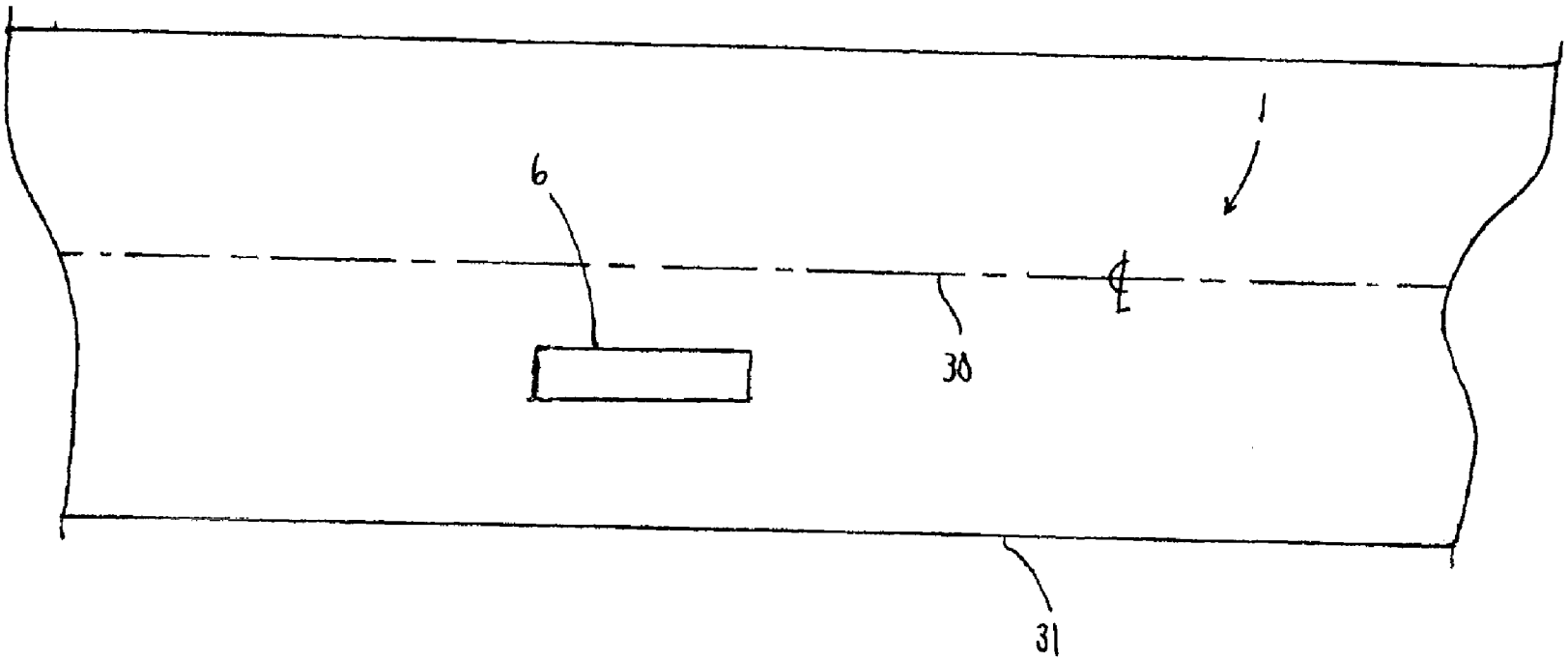
FIG. 8 depicts the positioning of the reed relay relative on the bottom of a model train car.

As can be appreciated from the figures discussed above, the field from the electromagnet 14 is preferably approximately parallel to the track 8, although other arrangements are within the scope of the invention. The coil 25 senses orthogonal to the field. Thus, a current is induced in the coil 25 that, in turn, produces an electromagnetic field that holds the reeds 28 and 29 in contact with one another. As is shown in FIG. 8, the relay 6 is preferably offset transversely from the center 30 of the car body on the bottom 31 of the car 1. If the reed relay 6 is centered exactly over the electromagnet 14, the lines of magnetic flux exerted on the coil 25 by the electromagnet would sum to zero and no current would flow in the coil 25.

Figure 9:
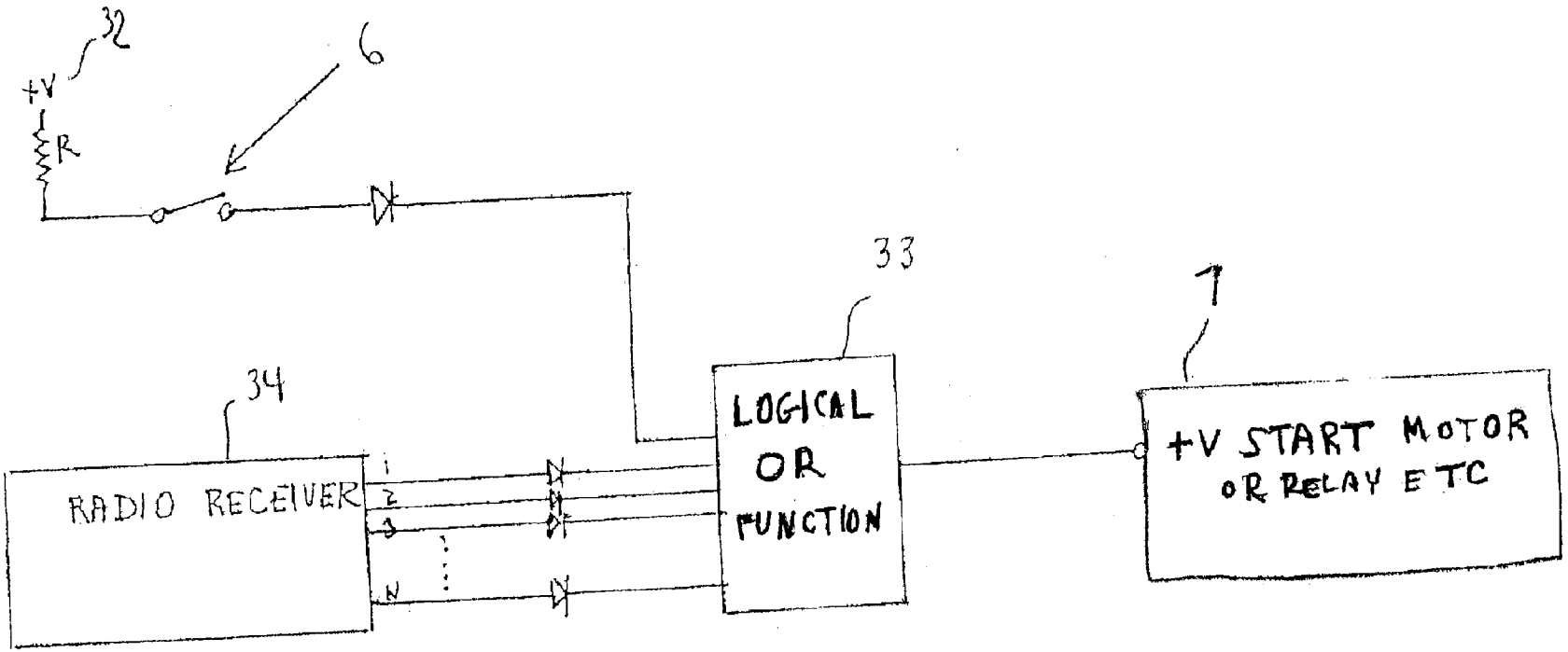
FIG. 9 is a schematic diagram of an arrangement according to the present invention for controlling a train car function.

The electrical circuitry to operate the motor 7 is schematically shown in FIG. 9. As can be appreciated from FIG. 9, when the reed relay 6 is closed, a voltage is applied across the circuit, current flows to a "OR" circuit 33 from the voltage source 32. In the preferred embodiment, the "OR" circuit 33 can be satisfied by either the current coming from the reed relay 6 or current energized by a radio receiver 34. The "OR" circuit 33 can have any number of additional inputs, for example, slide shoes or manual activation. In effect, the reed relay 6 enables the motor 7 in the train car to be operated with the electromagnet 14 in the track 8 in the same manner as if the signal were coming from the radio transmitter. Of course, the present invention includes an embodiment in which there is no radio in which there is no radio transmitter or "OR" circuit, and the reed relay 6 is connected directly to the motor 7 to operate the motor.

Figure 10:
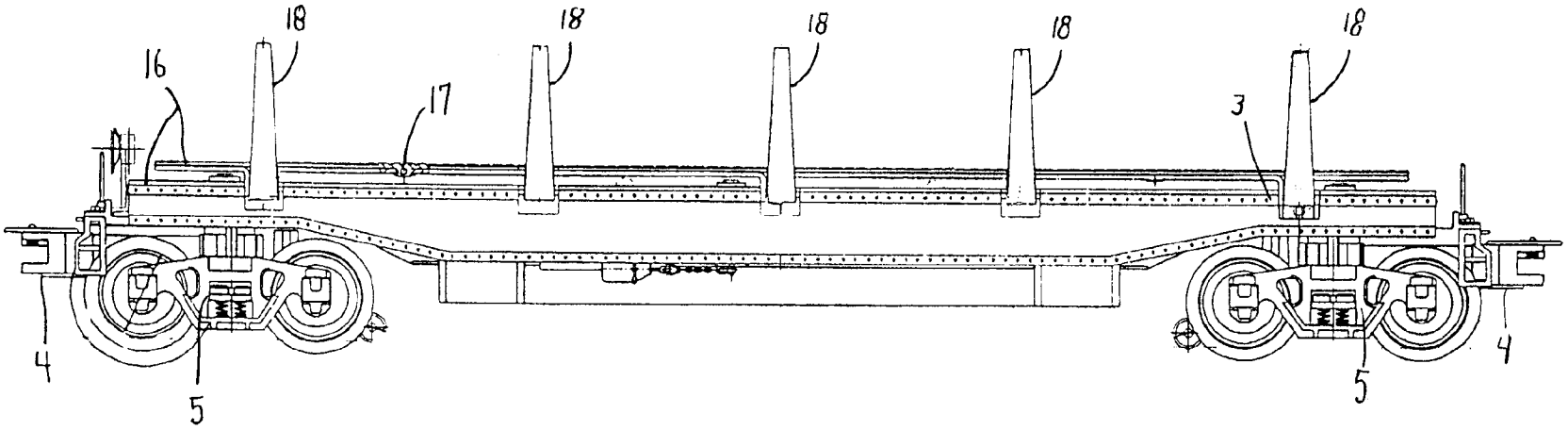
FIG. 10 is a side elevational view of a model train log car, in an unactuated position, incorporating a reed relay of the present invention.
Figure 11:
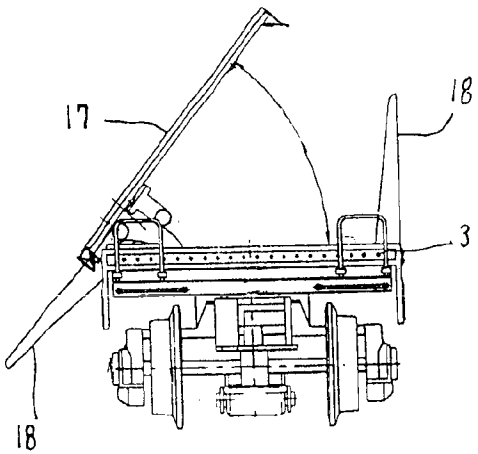
FIG. 11 is left end view of the log car of FIG. 10 after actuation of the reed relay.

A variety of functions are possible with the reed relay operation of the present invention. As is shown in FIGS. 10 and 11, a model train log car 16 has a flat movable plate 17 as the base of the car body. Extender stakes 18 support toy logs or other loads. When the reed relay 6 closes and current is supplied to the motor 7, the motor 7 turns a shaft with an eccentric cam. The turning of the eccentric cam lifts one side of the movable plate 17. When the movable plate 17 is lifted, the extender stakes 18 are pivoted to allow the model logs to roll out of the car. The movable plate 17 and extender stakes then pivot back into the initial position.

Figure 12:
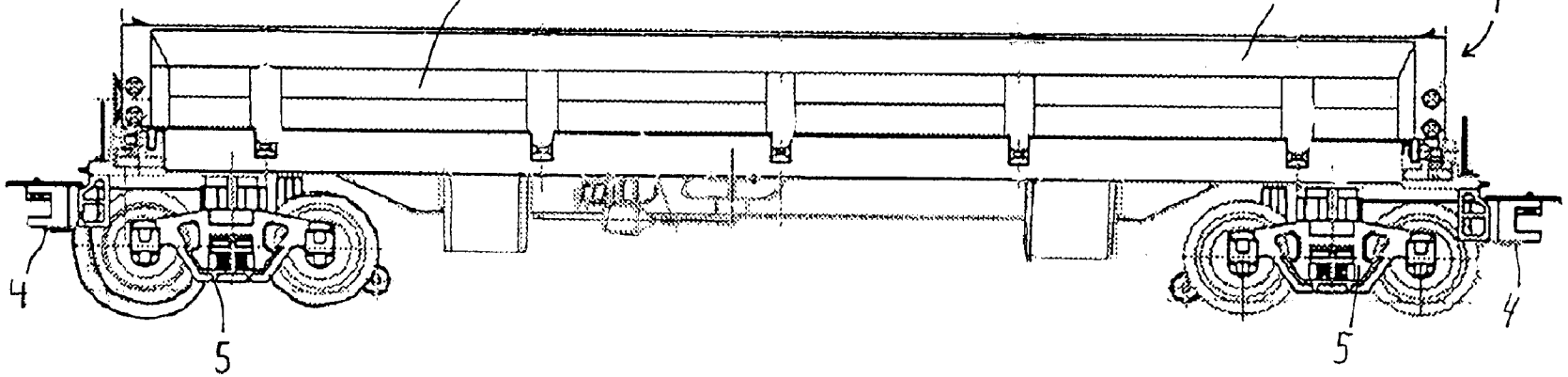
FIG. 12 is a side elevational view of a model train coal car in accordance with the present invention.
Figure 14:
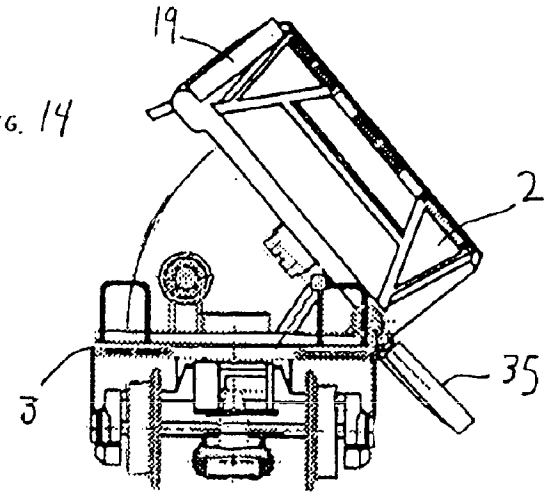
FIG. 14 is an end view of the coal car of FIG. 12 after actuation of the reed relay.
Figure 13:
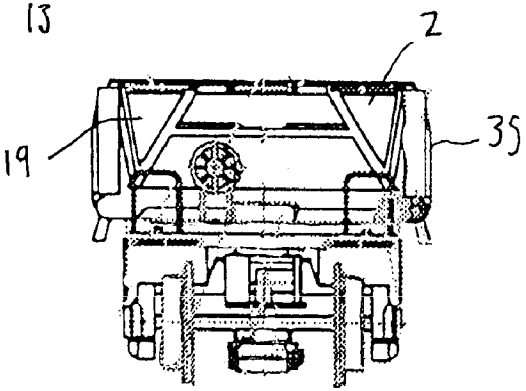
FIG. 13 is an end view of the coal car of FIG. 12 prior to actuation of the reed relay.

Similarly, FIGS. 12–14 show a model train coal car 19 that has a body with sides 35 but no top. The operation of the train car 19 is similar to the model train log car 16 shown in FIGS. 10 and 11. The motor 7 has a shaft with an eccentric cam that lifts one side of the car body 19. The car body tilts to one side and the side 35 of the car pivots to allow a load of coal, stones, or other load to be roll or fall out of the train car. The coal car 19 and side 35 then pivots back into the initial position.

A model train log car 16 is shown in FIGS. 7 and 8, and a model train coal car 19 is shown in FIGS. 12–14. However, it can be appreciated that the reed relay can be used to actuate a motor or solenoid to perform a wide variety of functions which are within the scope of the present invention. Furthermore, the reed switch can activate additional motors on a single car. In alternate embodiments, the train cars do not include a train body of shell. The reed switch can also actuate a motor to perform a function on a car with only a base, such as a flat car. In the preferred embodiment, the train cars in accordance with the present invention are operating freight cars. However, the reed switch can also be used on any train car or vehicle, such as a passenger car or engine.

While various embodiments of the present invention have been described above, it should be understood that they have been presented by way of example only, and not limitation. Thus, the breadth and scope of the present invention should not be limited by any of the above-described exemplary embodiments, but should instead be defined only in accordance with the following claims and their equivalents.

What is claimed is:

1. An apparatus for performing a function on a model train car on a track, comprising:

an electrically operated mechanism mounted on the car for performing a function on the car;

a reed relay operatively connected to the mechanism for activating the mechanism, the reed relay comprising an arrangement for assisting the magnet in moving the reed contacts of the reed switch from the first position to the second position and including a reed switch having contacts movable from a first position in which the contacts are out of contact with one another, to a second position, in which the contacts are in contact with one another; and a magnet associated with the track for moving the contacts of the reed switch from the first position to the second position to activate the mechanism, wherein the reed switch includes a glass envelope enclosing the reed contacts, the reed relay including a coil extending around the glass envelope, the coil being in a circuit, at least a portion of the circuit being positioned in at least a part of the magnetic field of the magnet, whereby the magnetic field induces a current in the coil to assist the magnet in moving the reed contacts from the first position to the second position.

2. The apparatus of claim 1, further comprising at least one additional mechanism mounted on the car for performing at least one additional function mounted on the car, the at least one additional mechanism being activated by the reed switch.

3. The apparatus of claim 1, wherein the mechanism can be additionally activated by at least one of radio control, a slide shoe, and manual activation.

4. The apparatus of claim 1, wherein the magnet is an electromagnet.

5. The apparatus of claim 1, wherein the magnet produces an electromagnetic field, and wherein the contacts of the reed switch are moved directly by the electromagnetic field of the magnet.

6. The apparatus of claim 1, wherein the magnet is an electromagnet operated by an AC signal.

7. An apparatus for performing a function on a model train car on a track, comprising:

an electrically relay operatively connected mechanism mounted on the car for performing function on the car;

a reed relay operatively connected to the mechanism for activating the mechanism, the reed relay comprising an arrangement for assisting the magnet in holding the reed contacts of the reed switch in the second position and including a reed switch having contacts movable from a first position, in which the contacts are out of contact with one another, to a second position, in which the contacts are in contact with one another; and a magnet associated with the track for moving the contacts of the reed switch from the first position to the second position to activate the mechanism, wherein the reed switch includes a glass envelope enclosing the reed contacts, the reed relay including a coil extending around the glass envelope, the coil being in a circuit, at least a portion of the circuit being positioned in at least a part of the magnetic field of the magnet, whereby the magnetic field induces a current in the coil to assist the magnet in holding the reed contacts in the second position.

8. A model train car, comprising:

an electrically operated mechanism for performing a function on the car; and a reed relay operatively connected to the mechanism for activation the mechanism, the reed relay comprising an arrangement for assisting the magnet in moving the reed contacts of the reed switch from the first position to the second position and including a reed switch having contacts movable from a first position, in which the contacts are out of contact with one another, to a second position, in which the contacts are in contact with one another, the train car being adapted to roll on a track, and the reed switch being positioned on the train car such that the contacts can be moved from the first position to the second position by a magnet associated with the track, wherein the reed switch includes a glass envelope enclosing the reed contacts, the reed relay including a coil extending around the glass envelope, the coil being in a circuit, at least a portion of the circuit being positioned in at least a part of the magnetic field of the magnet, whereby the magnetic field induces a current in the coil to assist the magnet in moving the reed contacts from the first position to the second position.

9. The model train car of claim 8, further comprising at least one additional mechanism for performing at least one additional function, the at least one additional mechanism being activated by the reed switch.

10. The model train car of claim 9, further comprising a model train car body adapted for carrying a load, wherein the mechanism, when activated, tilts the car body to unload the load.

11. The model train car of claim 10, wherein the model train car body is at least one of a model train coal car and a model train log car.

12. The model train car of claim 8, wherein the mechanism can be additionally activated by at least one of radio control, a slide shoe, and manual activation.

13. The model train car of claim 8, wherein the reed relay comprises an arrangement for assisting the magnet in holding the reed contacts of the reed switch in the second position.

14. The model train car of claim 8, wherein the magnet produces an electromagnetic field, and wherein the contacts of the reed switch are moved directly by the electromagnetic field of the magnet.

15. The model train car of claim 8, wherein the reed switch is positioned on the train car such that the contacts can be moved from the first position to the second position by an electromagnet operated by an AC signal.

16. A model train car, comprising:

an electrically operated mechanism for performing a function on the car; and a reed relay operatively connected to the mechanism for activating the mechanism, the reed switch from the first position to the second position and including a reed switch having contacts movable from a first position, in which the contacts are out of contact with one another, to a second position, in which the contacts are in contact with one another, the train car being adapted to roll on a track, and the reed switch being positioned on the train car such that the contacts can be moved from the first position to the second position by a magnet associated with the track, wherein the reed switch includes a glass envelope enclosing the reed contacts, the reed relay including a coil extending around the glass envelope, the coil being in a circuit, at least a portion of the circuit being positioned in at least a part of the magnetic field of the magnet, whereby the magnetic field induces a current in the coil to assist the magnet in holding the reed contacts in the second position.

* * * * *